US009631463B2

(12) United States Patent
Tao et al.

(10) Patent No.: US 9,631,463 B2
(45) Date of Patent: Apr. 25, 2017

(54) ACCUMULATOR COUNTERBALANCED THREE CHAMBER CYLINDER FOR ARTIFICIAL LIFT OPERATIONS

(71) Applicant: HALLIBURTON ENERGY SERVICES, INC., Houston, TX (US)

(72) Inventors: Tao Tao, Katy, TX (US); Mathew J. McEachern, Houston, TX (US); Huajun Chen, Katy, TX (US); Yanmei Li, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/646,761

(22) PCT Filed: Jul. 8, 2014

(86) PCT No.: PCT/US2014/045667
§ 371 (c)(1),
(2) Date: May 22, 2015

(87) PCT Pub. No.: WO2016/007131
PCT Pub. Date: Jan. 14, 2016

(65) Prior Publication Data

US 2016/0010437 A1 Jan. 14, 2016

(51) Int. Cl.
*E21B 43/12* (2006.01)

(52) U.S. Cl.
CPC ..... *E21B 43/126* (2013.01); *E21B 43/121* (2013.01)

(58) Field of Classification Search
CPC ..... F04B 47/04; F04B 9/107; F04B 9/1073; E21B 43/126; E21B 43/129; E21B 43/127
(Continued)

(56) References Cited

U.S. PATENT DOCUMENTS 3,782,117 A * 1/1974 James ..... F04B 47/04 417/904
4,380,150 A * 4/1983 Carlson ..... F04B 47/04 60/372
(Continued)

OTHER PUBLICATIONS

International Search Report with Written Opinion issued Mar. 31, 2015 for PCT Patent Application No. PCT/US14/045667, 14 pages.
(Continued)

*Primary Examiner* — James G Sayre
(74) *Attorney, Agent, or Firm* — McGuireWoods LLP

(57) ABSTRACT

An artificial lift system for use with a subterranean well can include a cylinder having a piston reciprocably disposed therein, the piston having opposing sides, one side being selectively communicable with at least one accumulator, and the other side having two areas, each of the areas being selectively communicable with a hydraulic pressure source and a hydraulic reservoir, and a gas pressure source connected to the accumulator, the gas pressure source including a gas compressor connected between at least one gas container and the accumulator. A method of controlling an artificial lift system can include connecting a cylinder to a hydraulic pressure source and to at least one accumulator, the accumulator being connected to a gas pressure source, and operating a gas compressor of the gas pressure source, thereby increasing hydraulic pressure applied to the cylinder from the accumulator.

19 Claims, 5 Drawing Sheets

(58) Field of Classification Search
USPC ..... 166/372, 68, 105, 370, 105.2
See application file for complete search history.

(56) References Cited

U.S. PATENT DOCUMENTS 4,480,685 A * 11/1984 Gilbertson ..... F04B 47/04 166/68.5
4,545,737 A * 10/1985 Stanton ..... E21B 17/07 417/399
4,631,918 A 12/1986 Rosman
4,691,511 A 9/1987 Dollison
4,715,180 A * 12/1987 Rosman ..... B66D 1/08 60/372
4,762,473 A * 8/1988 Tieben ..... E21B 43/127 417/399
4,801,126 A 1/1989 Rosman
4,848,085 A * 7/1989 Rosman ..... F04B 47/04 166/68
5,778,669 A * 7/1998 Kubik ..... F15B 1/02 60/372
8,261,838 B2 * 9/2012 Bullen ..... E21B 43/129 166/372
8,267,378 B1 9/2012 Rosman
8,336,613 B2 * 12/2012 Ramsey ..... F04B 47/04 166/68
2007/0044654 A1 3/2007 Schedgick et al.
2007/0068754 A1 3/2007 Furgala
2007/0278752 A1 12/2007 Schedgick
2009/0194291 A1 * 8/2009 Fesi ..... E21B 43/126 166/369
2010/0300679 A1 12/2010 Lorimer et al.
2010/0300701 A1 12/2010 Bullen
2012/0073668 A1 * 3/2012 Bold ..... F15B 1/165 137/1
2014/0014318 A1 * 1/2014 Mail ..... B66B 9/04 166/77.4

OTHER PUBLICATIONS

Specification and drawings for U.S. Appl. No. 14/646,813, filed May 22, 2015, 24 pages.
International Search Report and Written Opinion issued Apr. 8, 2015 for IA PCT/US14/045698, 14 pages.
International Search Report and Written Opinion issued Apr. 9, 2015 for IA PCT/US14/045681, 14 pages.
Specification and Drawings for U.S. Appl. No. 14/655,413, filed Jun. 25, 2015, 20 pages.

* cited by examiner

ACCUMULATOR COUNTERBALANCED THREE CHAMBER CYLINDER FOR ARTIFICIAL LIFT OPERATIONS

TECHNICAL FIELD

This disclosure relates generally to equipment utilized and operations performed in conjunction with a subterranean well and, in one example described below, more particularly provides an accumulator counterbalanced three-chamber cylinder for artificial lift operations.

BACKGROUND

Artificial lift systems are used to lift fluids from wells in situations in which fluid reservoir pressure is insufficient to flow the fluids to surface. It is important that artificial lift systems operate efficiently and are economical to construct, so that they are cost-effective in use. Therefore, it will be appreciated that improvements are continually needed in the art of constructing and operating artificial lift systems for wells.

DETAILED DESCRIPTION

Figure 1:
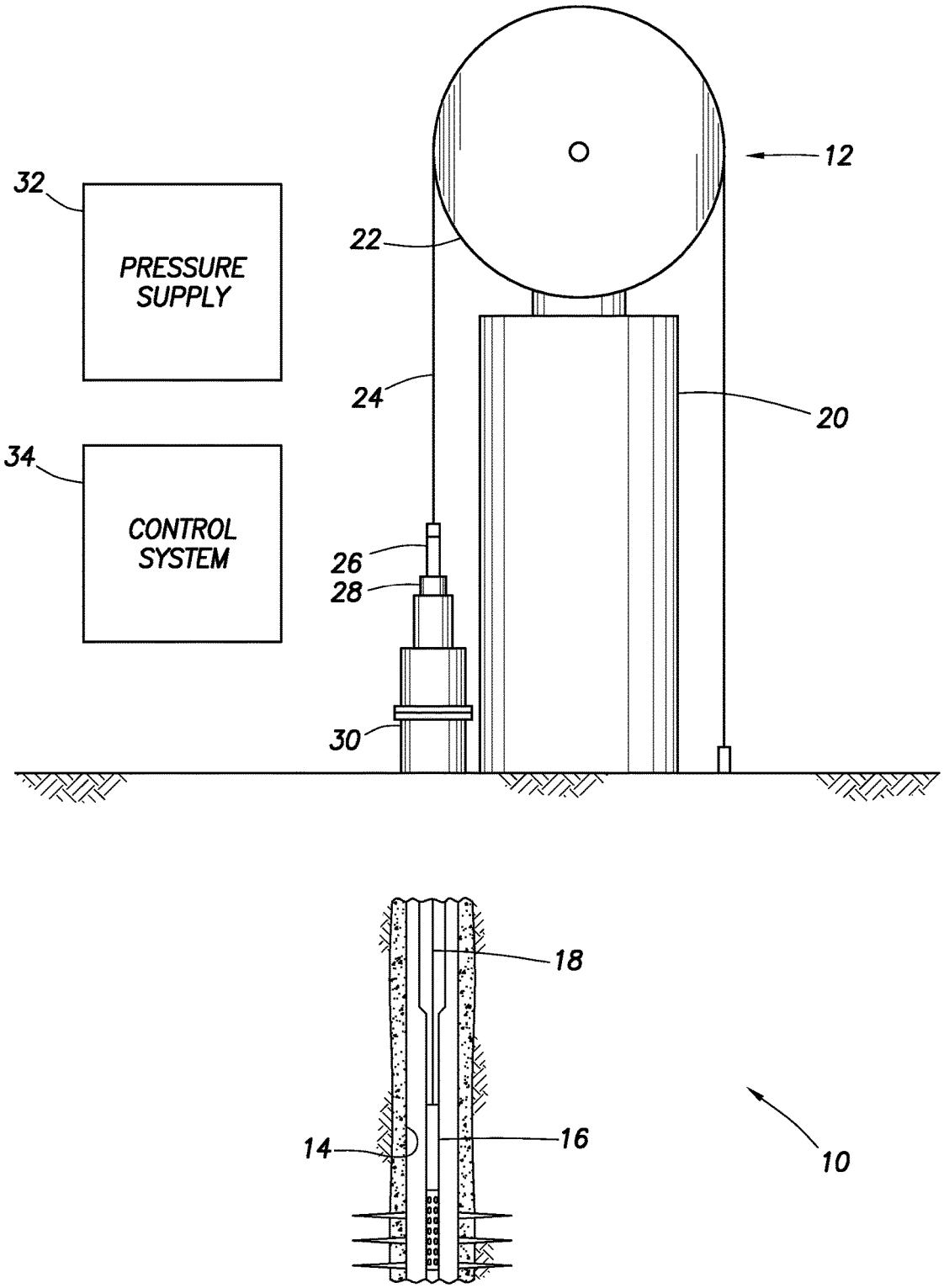
FIG. 1 is a representative partially cross-sectional view of an artificial lift system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, an artificial lift system 12 is used to pump fluid (such as hydrocarbons, water, etc.) from a wellbore 14. For this purpose, the artificial lift system 12 includes a downhole pump 16 that is actuated by reciprocation of a rod 18 (such as, a sucker rod).

In this example, the rod 18 is reciprocated by means of a cylinder 20, sheave 22 and cable 24 at or near the earth's surface. The cylinder 20 is used to displace the sheave 22 repeatedly up and down, thereby causing an end of the cable 24 attached to a polished rod 26 to reciprocate upward and downward.

The polished rod 26 is received in a stuffing box 28 on a wellhead 30. The polished rod 26 is connected to the rod 18, so that the rod 18 is reciprocated, thereby causing the pump 16 to produce fluids upward to the wellhead 30.

A pressure supply 32 is used to actuate the cylinder 20, in order to cause the sheave 22 to displace upward and downward. A control system 34 is used to control operation of the cylinder 20 and pressure supply 32.

Figure 2:
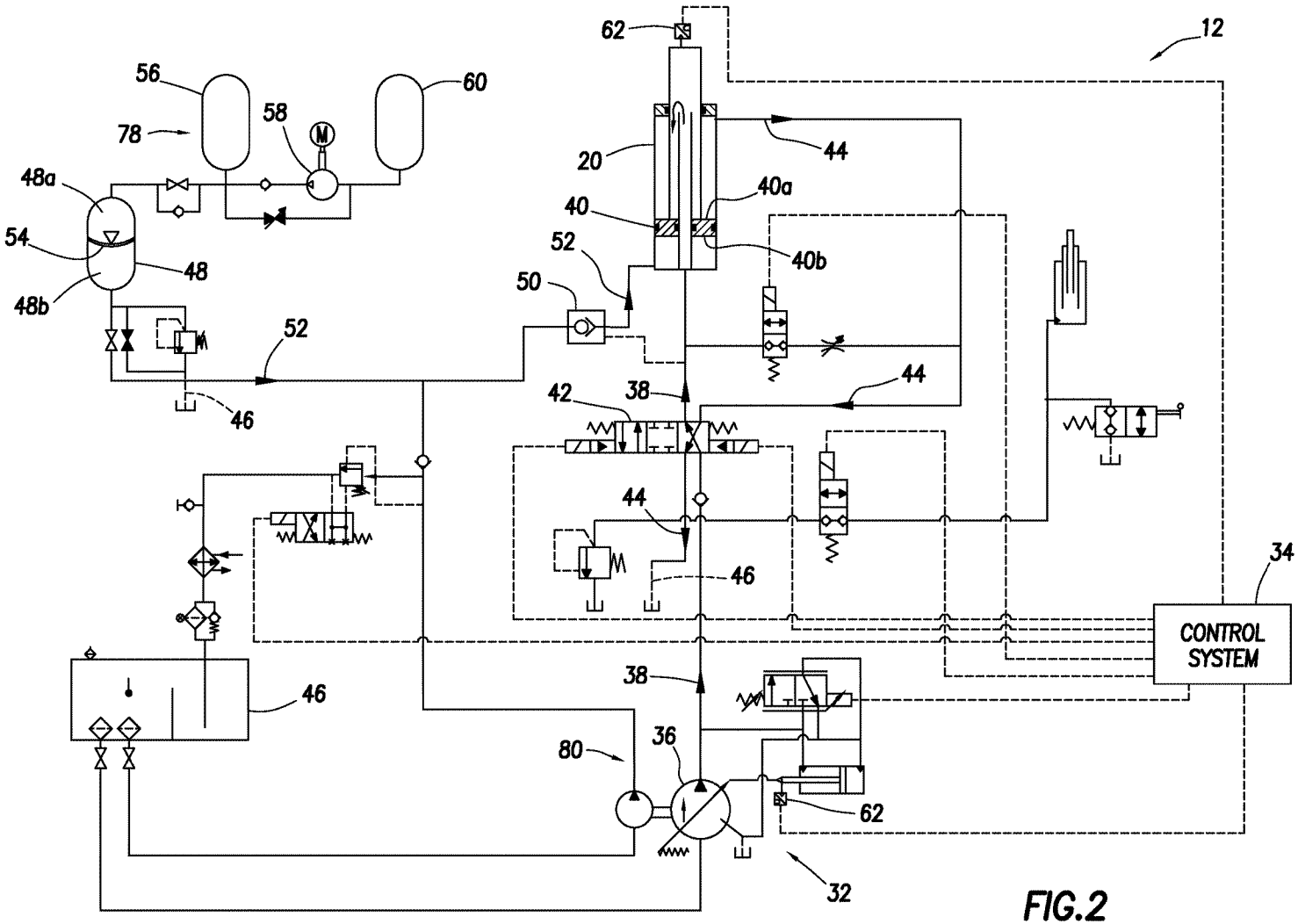
FIG. 2 is a representative hydraulic schematic for a lifting stage of operation.

Referring additionally now to FIG. 2, a schematic diagram of the artificial lift system 12 is representatively illustrated. Only the cylinder 20, pressure supply 32 and control system 34 are depicted in FIG. 2, so that the manner in which operation of the cylinder is controlled can be more clearly seen.

The pressure supply 32 includes a hydraulic pump 36 for delivering pressurized fluid 38 to an upper side 40*a* of an annular piston 40 in the cylinder 20. The pump 36 is a variable displacement pump with electronic proportional control in this example, but the scope of this disclosure is not limited to use of any particular type of pump.

The pump 36 and associated equipment can be considered a hydraulic pressure source 80 for delivering pressurized fluid 38 to the cylinder 20. However, other types of hydraulic pressure sources may be used in keeping with the principles of this disclosure.

The fluid 38 is directed alternately to two separate areas on the piston 40, depending on a position of a control valve 42 connected between the pump 36 and the cylinder 20. In the configuration of FIG. 1, the fluid 38 is directed to a smaller, inner annular area of the upper piston side 40*a*.

The control valve 42 also directs a reduced pressure fluid 44 from the cylinder 20 to a fluid reservoir 46, from which the pump 36 draws. The reduced pressure fluid 44 is displaced from the cylinder 20 due to upward displacement of the piston 40. The fluid 44 is exposed to a larger, outer annular area of the upper piston side 40*a*.

The piston 40 displaces upward in the FIG. 2 configuration due to fluid pressure applied from an accumulator 48 to the lower side 40*b* of the piston 40. The pressurized fluid 38 delivered by the pump 36 acts on a pilot-controlled check valve 50, thereby opening the valve and allowing pressurized fluid 52 to flow through the valve and into the cylinder 20, where the fluid acts on the lower side 40*b* of the piston 40.

Sufficient pressure is exerted by the fluid 52 on the lower side 40*b* to overcome the pressures exerted by the fluids 38, 44 on the upper side 40*a* of the piston, in addition to force required to lift the rods 18, 26, so that the piston 40 is displaced upward, thereby displacing the sheave 22 (see FIG. 1) upward. It will be appreciated that the accumulator 48 should be charged with pressure accordingly.

In the FIG. 2 example, the accumulator 48 is a bladder-type accumulator, having a flexible bladder 54 therein for separating an upper gas-charged volume 48*a* of the accumulator from a lower fluid filled volume 48*b*. Only one accumulator 48 is depicted in FIG. 2, but multiple accumulators may be used if desired. In addition, accumulators other than bladder-type accumulators (such as, piston-type accumulators, etc.) may be used if desired. Thus, the scope of this disclosure is not limited to use of any particular type or number of accumulator.

The accumulator volume 48*a* is pressurized by a pressurized gas container 56 connected thereto. The gas container 56 could be, for example, a pressurized nitrogen bottle (or another pressurized inert gas container). Multiple gas containers 56 may be used if desired to provide sufficient pressurized gas volume. Thus, the scope of this disclosure is not limited to use of any particular type or number of gas container.

In the event that pressure in the accumulator 48 and gas container 56 is less than a desired level (such as, due to leakage, a requirement for more force output from the cylinder 20, etc.), a gas compressor 58 can be used to increase the pressure. The gas compressor 58 in the FIG. 2 example is supplied with gas from another gas container 60.

Thus, one or more gas container(s) 56 are on a discharge side of the gas compressor 58, and one or more gas container(s) 60 are on a supply side of the gas compressor.

The gas container 56, compressor 58 and gas container 60 can be considered as a gas pressure source 78 for supplying gas pressure to the accumulator 48. However, other types of gas pressure sources may be used, in keeping with the principles of this disclosure.

As depicted in FIG. 2, the cylinder 20 is extended by displacing the piston 40 upward. The piston 40 is displaced upward by operating the control valve 42 to direct pressurized fluid 38 from the pump 36 to the inner, smaller area of the upper side 40*a* of the piston 40. This pressurized fluid 38 causes the pilot-operated check valve 50 to open, thereby allowing pressurized fluid 52 to flow from the accumulator 48 to the lower side 40*b* of the piston 40.

The pressure on the lower side 40*b* of the piston 40 is sufficiently great to displace the piston upward. As the piston 40 displaces upward, the fluid 44 is discharged from the cylinder 20 and flows via the control valve 42 to the reservoir 46.

The control system 34 controls operation of the control valve 42. For example, the control system 34 will operate the control valve 42 to its FIG. 2 configuration when it is desired to upwardly displace the piston 40.

The control system 34 receives input from a variety of sensors 62 (such as, pressure sensors, position sensors, limit switches, proximity sensors, level sensors, etc., not all of which are shown in the drawings) in the system 12, so that the control system can determine when and how to operate the control valve 42 and other equipment in the system. For example, the control system 34 can receive an indication from a sensor 62 on the cylinder 20 that the piston 40 has reached a bottom of its stroke, and in response the control system can operate the control valve 42 to its FIG. 2 configuration to thereby cause the piston 40 to displace upward.

Figure 3:
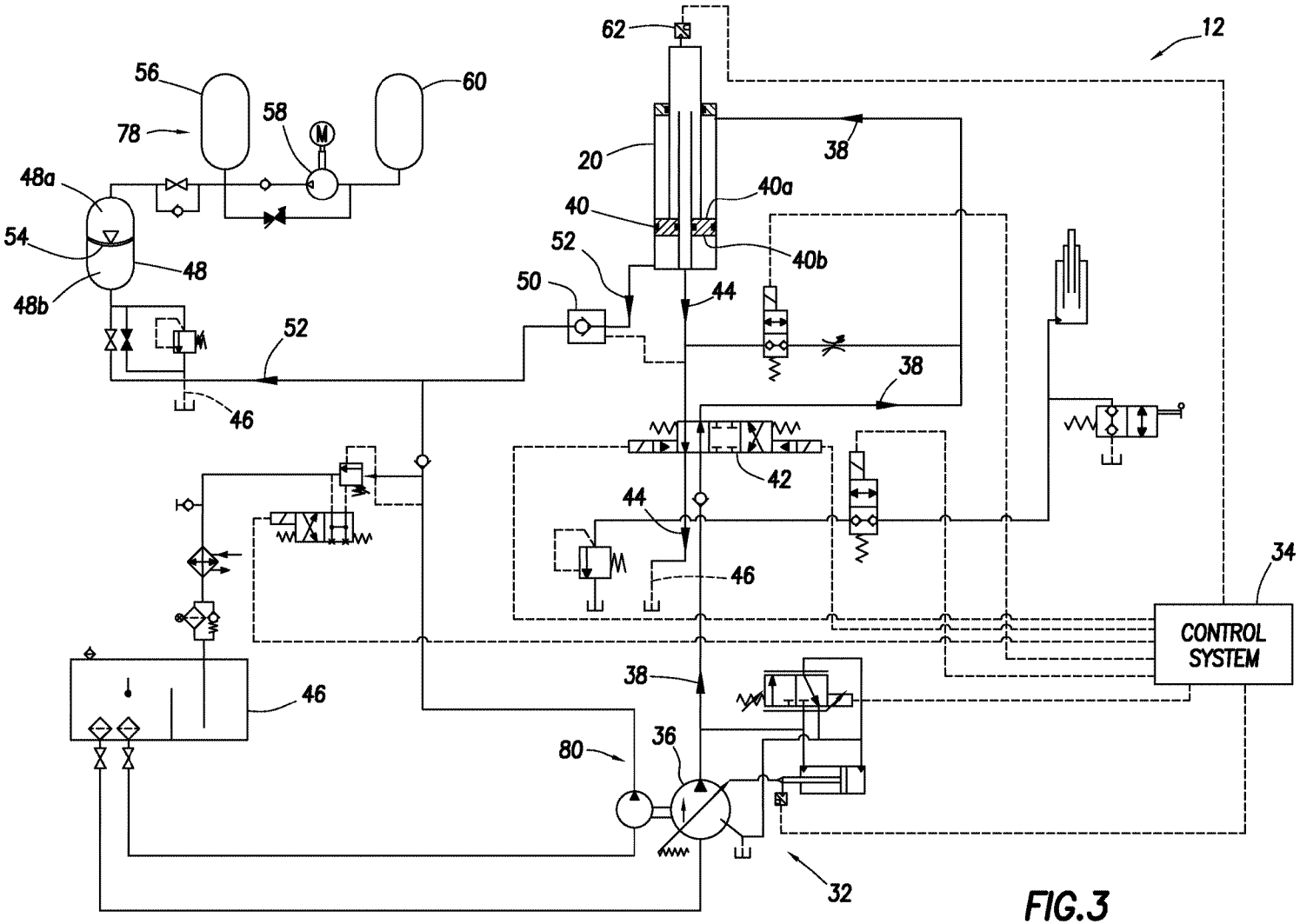
FIG. 3 is a representative hydraulic schematic for a retracting stage of operation.

Referring additionally now to FIG. 3, the system 12 is representatively illustrated in a configuration in which the piston 40 is being displaced downward. In order to downwardly displace the piston 40, the control system 34 operates the control valve 42 so that pressurized fluid 38 from the pump 36 is directed to the larger, outer area on the upper side 40*a* of the piston 40. Reduced pressure fluid 44 is directed from the smaller, inner area of the upper side 40*a* of the piston 40 to the reservoir 46 by the control valve 42.

Fluid 52 is flowed back to the accumulator 48 via the check valve 50. The pressurized fluid 38 acting on the larger, outer area of the upper side 40*a* of the piston 40, combined with a weight of the rods 18, 26, etc., is great enough to overcome the pressurized fluid 52 acting on the lower side 40*b* of the piston 40, so that the piston 40 displaces downwardly.

The control system 34 will operate the control valve 42 to its FIG. 3 configuration when it is desired to downwardly displace the piston 40. For example, the control system 34 can receive an indication from a sensor 62 on the cylinder 20 that the piston 40 has reached a top of its stroke, and in response the control system can operate the control valve 42 to its FIG. 3 configuration to thereby cause the piston 40 to displace downward.

Figure 4:
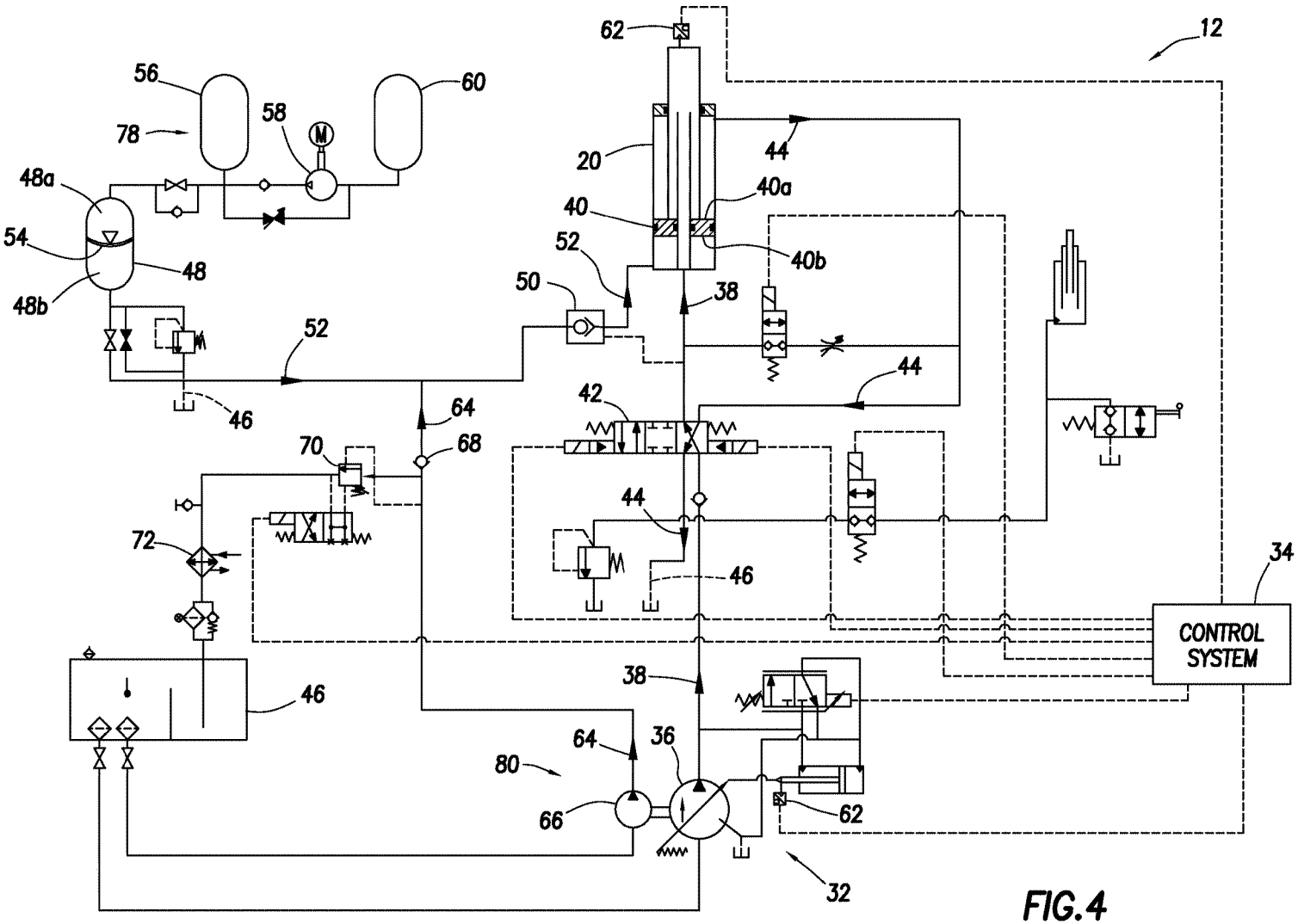
FIG. 4 is a representative hydraulic schematic for a cooling and/or make-up stage of operation.

Referring additionally now to FIG. 4, the system 12 is representatively illustrated in a cooling and/or make-up configuration. In this configuration, additional fluid 64 is added to the accumulator volume 48*b* (e.g., the fluid volume in the accumulator and exposed to the lower side 40*b* of the piston 40), if needed to, for example, compensate for any leakage, etc.

The FIG. 4 configuration is substantially similar to the FIG. 2 configuration, but an additional auxiliary pump 66 is used to pump fluid 64 from the reservoir 46 and via a check valve 68 into the accumulator volume 48*b* (and the rest of the volume between the accumulator 48 and the lower side 40*b* of the piston 40). The pump 66 is a gear pump in the FIG. 4 example, but other types of pumps may be used, if desired.

If it is desired to reduce a temperature of the reservoir 46 (and fluids being pumped therefrom), a solenoid vented relief valve 70 can be operated by the control system 34 to circulate the fluid from the pump 66 back to the reservoir continuously, until the temperature has decreased sufficiently. A heat exchanger 72 removes heat from the fluid as it circulates.

Figure 5:
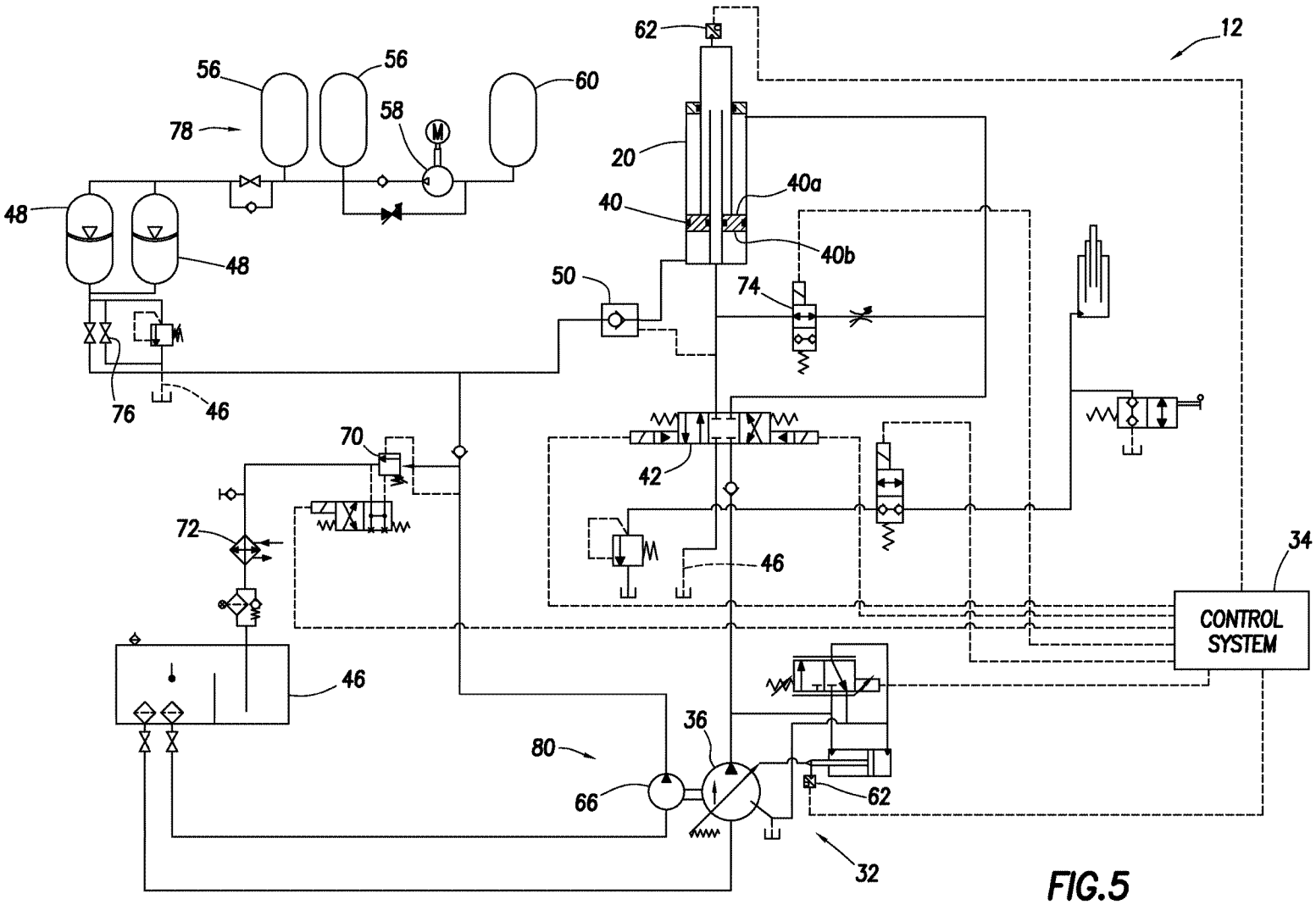
FIG. 5 is a representative hydraulic schematic for a remedial stage of operation.

Referring additionally now to FIG. 5, a configuration of the system 12 is representatively illustrated, in which the piston 40 can be displaced without use of fluid pressure. Such a configuration could be useful, for example, if the pump 36 has failed or is otherwise not operated, and it is desired to lower the piston 40, in order to perform maintenance, upgrade or repair operations on the system 12.

The control system 34 operates the control valve 42 to a position in which the two areas (the larger, outer area and the smaller, inner area) on the upper side 40*a* of the piston 40 are prevented from communicating with the pump 36 and the reservoir 46. The control system 34 also operates another valve 74 to thereby place these areas on the upper side 40*a* of the piston 40 in communication with each other.

Another valve 76 is opened (for example, manually, or by the control system 34), thereby venting pressure from the accumulator 48 to the reservoir 46. The piston 40 will then displace downward, for example, due to the weight of the rods 18, 26, etc., applied to the sheave 22 above the cylinder 20.

Another difference in the FIG. 5 example is that multiple accumulators 48 and multiple gas containers 56 are provided. Multiple gas containers 60 on the supply side of the gas compressor 58 may also be provided, if desired. The multiple accumulators 48 and gas containers 56 allow for use of readily available standard-sized accumulators and pressurized bottles, thereby eliminating a need for customized accumulators and/or gas containers to be made. However, customized accumulators and/or gas containers may be used in keeping with the scope of this disclosure.

It may now be fully appreciated that the above disclosure provides significant advancements to the art of constructing and operating artificial lift systems for wells. The system 12 described above is efficient, effective, responsive, and convenient and economical to construct and operate.

An artificial lift system 12 for use with a subterranean well is provided to the art by the above disclosure. In one example, the system 12 comprises a cylinder 20 having a piston 40 reciprocably disposed therein, the piston 40 having first and second opposing sides 40*a,b*, the first side 40*a* having first and second areas, each of the first and second areas being selectively communicable with a hydraulic pressure source 80 and a hydraulic reservoir 46, and the second side 40*b* being selectively communicable with at least one accumulator 48; and a gas pressure source 78 connected to the accumulator 48, the gas pressure source including a gas compressor 58 connected between at least one first gas container 60 and the accumulator 48.

The gas pressure source can also include at least one second gas container 56 connected to a discharge side of the gas compressor 58. The second gas container 56 is connected to the accumulator 48. The "at least one" second gas container 56 can comprise multiple second gas containers.

The accumulator 48 may include a bladder 54. The bladder 54 may be exposed on one side to the gas pressure source 78, and on an opposite side the bladder may be selectively communicable with the second side 40*b* of the piston 40.

The "at least one" accumulator 48 can comprise multiple accumulators.

A method of controlling an artificial lift system 12 is also provided to the art by the above disclosure. In one example, the method comprises connecting a cylinder 20 to a hydraulic pressure source 80 and to at least one accumulator 48, the accumulator 48 being connected to a gas pressure source 78, and operating a gas compressor 58 of the gas pressure source, thereby increasing hydraulic pressure applied to the cylinder 20 from the accumulator 48.

The method may include connecting at least one gas container 56 to a discharge side of the gas compressor 58. The method may include connecting the gas container 56 to the accumulator 48.

The accumulator 48 may include a bladder 54, and the bladder may be exposed on one side to the gas pressure source 78, and on an opposite side the bladder 54 may be selectively communicable with the cylinder 20.

A well system 10 is also described above. In one example, the well system 10 comprises a downhole pump 16 actuated by reciprocation of a rod 18, a cylinder 20 that reciprocates the rod 18 in response to pressure applied to the cylinder 20, the cylinder 20 having a piston 40 reciprocably disposed therein, the piston 40 having opposing first and second sides 40*a,b*, at least one accumulator 48 that applies pressure to the second side 40*b* of the piston 40, a hydraulic pressure source 80 that applies pressure to the first side 40*a* of the piston 40, and a gas compressor 58 that increases gas pressure applied to the accumulator 48.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An artificial lift system for use with a subterranean well, the system comprising:

a cylinder having a piston reciprocably disposed therein, the piston having first and second opposing sides, the first side having discrete first and second areas, each of the first and second areas being selectively communicable with a hydraulic pressure source and a hydraulic reservoir, and the second side being selectively communicable with at least one accumulator; and a gas pressure source connected to the accumulator, the gas pressure source including a gas compressor connected between at least one first gas container and the accumulator.

2. The system of claim 1, wherein the gas pressure source further comprises at least one second gas container connected to a discharge side of the gas compressor.

3. The system of claim 2, wherein the second gas container is connected to the accumulator.

4. The system of claim 2, wherein the at least one second gas container comprises multiple second gas containers.

5. The system of claim 1, wherein the accumulator comprises a bladder.

6. The system of claim 5, wherein the bladder is exposed on one side to the gas pressure source, and on an opposite side the bladder is selectively communicable with the second side of the piston.

7. The system of claim 1, wherein the at least one accumulator comprises multiple accumulators.

8. A method of controlling an artificial lift system, the method comprising:

connecting a cylinder to a hydraulic pressure source and to at least one accumulator, the accumulator being connected to a gas pressure source, wherein the cylinder has a piston reciprocably disposed therein, the piston having first and second opposing sides, the first side having discrete first and second areas, each of the first and second areas being selectively communicable with the hydraulic pressure source and a hydraulic reservoir, and the second side being selectively communicable with the accumulator; and operating a gas compressor of the gas pressure source, thereby increasing hydraulic pressure applied to the cylinder from the accumulator.

9. The method of claim 8, further comprising connecting at least one gas container to a discharge side of the gas compressor.

10. The method of claim 9, further comprising connecting the gas container to the accumulator.

11. The method of claim 9, wherein the at least one gas container comprises multiple gas containers.

12. The method of claim 8, wherein the accumulator comprises a bladder.

13. The method of claim 12, wherein the bladder is exposed on one side to the gas pressure source, and on an opposite side the bladder is selectively communicable with the cylinder.

14. The method of claim 8, wherein the at least one accumulator comprises multiple accumulators.

15. A well system, comprising:

a downhole pump actuated by reciprocation of a rod;

a cylinder that reciprocates the rod in response to pressure applied to the cylinder, the cylinder having a piston reciprocably disposed therein, the piston having opposing first and second sides, the first side having discrete first and second areas;

at least one accumulator that applies pressure to the second side of the piston;

a hydraulic pressure source that applies pressure to the first side of the piston; and a gas compressor that increases gas pressure applied to the accumulator.

16. The system of claim 15, further comprising at least one gas container connected to a discharge side of the gas compressor.

17. The system of claim 16, wherein the at least one gas container comprises multiple gas containers.

18. The system of claim 15, wherein the accumulator comprises a bladder.

19. The system of claim 15, wherein the at least one accumulator comprises multiple accumulators.

* * * * *